US009412359B2

(12) United States Patent
Beutnagel et al.

(10) Patent No.: US 9,412,359 B2
(45) Date of Patent: *Aug. 9, 2016

(54) SYSTEM AND METHOD FOR CLOUD-BASED TEXT-TO-SPEECH WEB SERVICES

(71) Applicant: AT&T Intellectual Property I, L.P., Atlanta, GA (US)

(72) Inventors: Mark Charles Beutnagel, Mendham, NJ (US); Alistair D. Conkie, San Jose, CA (US); Yeon-Jun Kim, Whippany, NJ (US); Horst Juergen Schroeter, New Providence, NJ (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/684,893

(22) Filed: Apr. 13, 2015

(65) Prior Publication Data

US 2015/0221298 A1 Aug. 6, 2015

Related U.S. Application Data

(63) Continuation of application No. 12/956,354, filed on Nov. 30, 2010, now Pat. No. 9,009,050.

(51) Int. Cl.
*G10L 13/00* (2006.01)
*G10L 13/04* (2013.01)

(52) U.S. Cl.
CPC ..... *G10L 13/04* (2013.01); *G10L 13/00* (2013.01); *G10L 13/043* (2013.01)

(58) Field of Classification Search
USPC ..... 704/260, 270.1
See application file for complete search history.

(56) References Cited

U.S. PATENT DOCUMENTS

| | | | | |
|---|---|---|---|---|
| 6,385,486 | B1 * | 5/2002 | John | A61B 5/0002 600/544 |
| 6,810,379 | B1 * | 10/2004 | Vermeulen | G10L 13/07 704/258 |
| 7,924,286 | B2 * | 4/2011 | Ostermann | G06T 13/40 345/419 |
| 8,103,509 | B2 | 1/2012 | Burns et al. | |
| 8,352,268 | B2 | 1/2013 | Naik et al. | |
| 2006/0095848 | A1 | 5/2006 | Naik | |
| 2008/0221902 | A1 * | 9/2008 | Cerra | G10L 15/065 704/270.1 |
| 2010/0082328 | A1 | 4/2010 | Rogers et al. | |
| 2011/0202344 | A1 | 8/2011 | Meyer et al. | |

* cited by examiner

*Primary Examiner* — Abul Azad

(57) ABSTRACT

Disclosed herein are systems, methods, and non-transitory computer-readable storage media for generating speech. One variation of the method is from a server side, and another variation of the method is from a client side. The server side method, as implemented by a network-based automatic speech processing system, includes first receiving, from a network client independent of knowledge of internal operations of the system, a request to generate a text-to-speech voice. The request can include speech samples, transcriptions of the speech samples, and metadata describing the speech samples. The system extracts sound units from the speech samples based on the transcriptions and generates an interactive demonstration of the text-to-speech voice based on the sound units, the transcriptions, and the metadata, wherein the interactive demonstration hides a back end processing implementation from the network client. The system provides access to the interactive demonstration to the network client.

20 Claims, 5 Drawing Sheets

SYSTEM AND METHOD FOR CLOUD-BASED TEXT-TO-SPEECH WEB SERVICES

PRIORITY INFORMATION

The present application is a continuation of U.S. patent application Ser. No. 12/956,354, filed Nov. 30, 2010, the contents of which is incorporated herein by reference in its entirety.

BACKGROUND

1. Technical Field

The present disclosure relates to synthesizing speech and more specifically to providing access to a backend speech synthesis process via an application programming interface (API).

2. Introduction

To a casual observer, any text-to-speech (TTS) system appears to be a black-box solution for creating synthetic speech from input text. In fact, TTS systems are mostly used as black-box systems today. In other words, TTS systems do not require the user or application programmer to have linguistic or phonetic skills. However, internally, such a TTS system has multiple, clearly separated modules with unique functions. These modules process expensive source speech data for a specific speaker or task using algorithms and approaches that may be closely guarded trade secrets.

Often, one party generates the source speech data by recording many hours of speech for a particular speaker in a high-quality studio environment. Another party has a set of highly tuned, effective, and proprietary TTS algorithms. In order for these two parties to collaborate one with another, each must provide the other access to their own intellectual property, which one or both parties may oppose. Thus, the current approaches available in the art force parties that may be at arm's length to either cooperate at a much closer level than either party wants or not cooperate at all. This friction prevents the benefits of TTS to spread in certain circumstances.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed are systems, methods, and non-transitory computer-readable storage media for generating speech and/or a TTS voice using a divided client-server approach that splits the front end from the back end via API calls. A server configured to practice the method receives, from a network client that has no access to and knowledge of internal operations of the server, a request to generate a text-to-speech voice, the request having speech samples, transcriptions of the speech samples, and metadata describing the speech samples. The server extracts sound units from the speech samples based on the transcriptions and generates an interactive demonstration of the text-to-speech voice based on the sound units, the transcriptions, and the metadata, wherein the interactive demonstration hides a back end processing implementation from the network client. Then the server provides access to the interactive demonstration to the network client. The server can optionally maintain logs associated with the text-to-speech voice and provide those logs as feedback to the client.

The server can also receive an additional request from the network client for the text-to-speech voice that is the subject of the interactive demonstration and provide the text-to-speech voice to the network client. In one aspect, the request is received via a web interface. The client and/or the server can impose a minimum quality threshold on the speech samples. The TTS voice can be language agnostic. In a variation designed to reduce the amount of redundant speech samples or to expedite the process of gathering speech samples, the server can analyze the speech samples to determine a coverage hole in the speech samples for a particular purpose. Then the server can suggest to the client a type of additional speech sample intended to address the coverage hole. The server and client can iterate through this approach several times until a threshold coverage for the particular purpose is reached.

On the other hand, the client can transmit to a server a request to generate the text-to-speech voice. The request can include speech samples, transcriptions of the speech samples, and metadata describing the speech samples such as a gender, age, or other speaker information, the conditions under which the speech samples were collected, and so forth. The client then receives a notification from the network-based automatic speech processing system that the text-to-speech voice is generated. This notification can arrive hours, days, or even weeks after the request, depending on the request, specific tasks, the speed of the server(s), a queue of tasks submitted before the client's request, and so forth. Then the client can test, via a network, the text-to-speech voice independent of knowledge of internal operations of the server and/or without access to and knowledge of internal operations of the server.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

The present disclosure addresses the need in the art for generating TTS voices with resources divided among multiple parties. A brief introductory description of a basic general purpose system or computing device in FIG. 1 which can be employed to practice the concepts is disclosed herein. A more detailed description of the server and client sides of generating a TTS voice will then follow. One new result from this approach is that two parties can cooperate to generate a text-to-speech voice without the need for either party disclosing its sensitive intellectual property, entire speech library, or proprietary algorithms with other parties. For example, a client side can provide audio recording and frontend capabilities to capture information. The client can upload that information to a server, via an API, for processing and transforming into a TTS voice and/or synthetic speech. These and other variations shall be discussed herein as the various embodiments are set forth. The disclosure now turns to FIG. 1.

Figure 1:
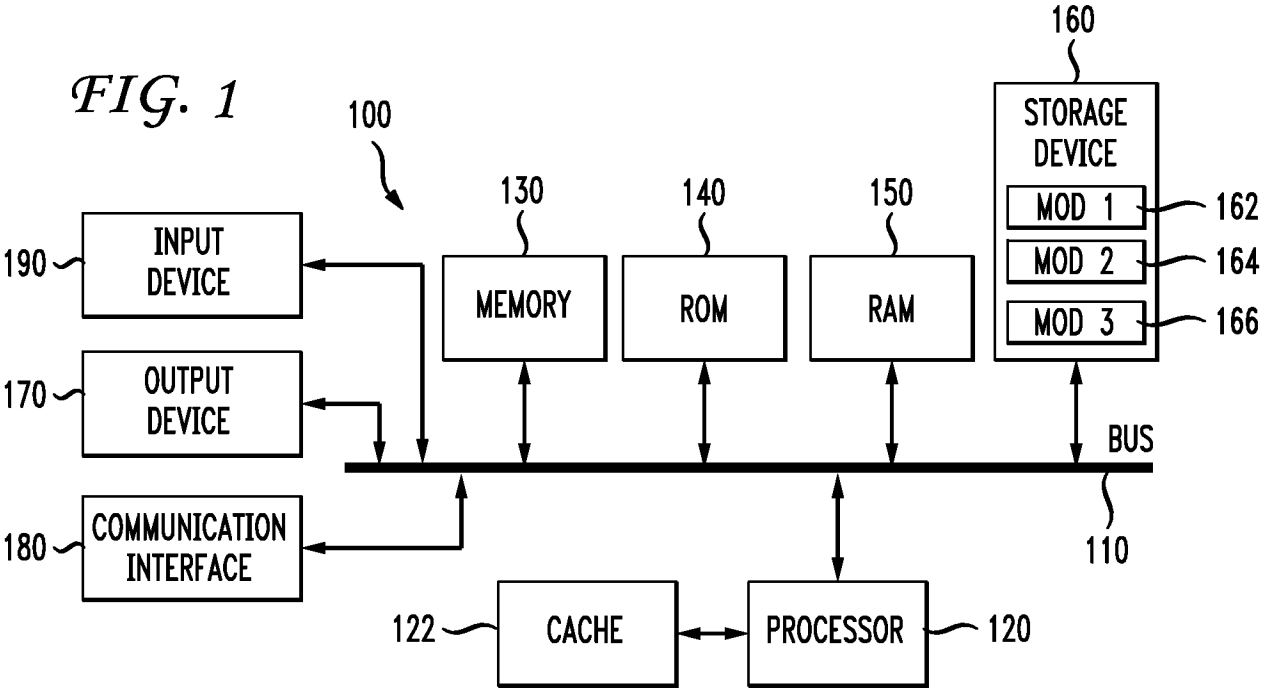
FIG. 1 illustrates an example system embodiment.

With reference to FIG. 1, an exemplary system 100 includes a general-purpose computing device 100, including a processing unit (CPU or processor) 120 and a system bus 110 that couples various system components including the system memory 130 such as read only memory (ROM) 140 and random access memory (RAM) 150 to the processor 120. The system 100 can include a cache of high speed memory connected directly with, in close proximity to, or integrated as part of the processor 120. The system 100 copies data from the memory 130 and/or the storage device 160 to the cache for quick access by the processor 120. In this way, the cache provides a performance boost that avoids processor 120 delays while waiting for data. These and other modules can control or be configured to control the processor 120 to perform various actions. Other system memory 130 may be available for use as well. The memory 130 can include multiple different types of memory with different performance characteristics. It can be appreciated that the disclosure may operate on a computing device 100 with more than one processor 120 or on a group or cluster of computing devices networked together to provide greater processing capability. The processor 120 can include any general purpose processor and a hardware module or software module, such as module 1 162, module 2 164, and module 3 166 stored in storage device 160, configured to control the processor 120 as well as a special-purpose processor where software instructions are incorporated into the actual processor design. The processor 120 may essentially be a completely self-contained computing system, containing multiple cores or processors, a bus, memory controller, cache, etc. A multi-core processor may be symmetric or asymmetric.

The system bus 110 may be any of several types of bus structures including a memory bus or memory controller, a peripheral bus, and a local bus using any of a variety of bus architectures. A basic input/output (BIOS) stored in ROM 140 or the like, may provide the basic routine that helps to transfer information between elements within the computing device 100, such as during start-up. The computing device 100 further includes storage devices 160 such as a hard disk drive, a magnetic disk drive, an optical disk drive, tape drive or the like. The storage device 160 can include software modules 162, 164, 166 for controlling the processor 120. Other hardware or software modules are contemplated. The storage device 160 is connected to the system bus 110 by a drive interface. The drives and the associated computer readable storage media provide nonvolatile storage of computer readable instructions, data structures, program modules and other data for the computing device 100. In one aspect, a hardware module that performs a particular function includes the software component stored in a non-transitory computer-readable medium in connection with the necessary hardware components, such as the processor 120, bus 110, display 170, and so forth, to carry out the function. The basic components are known to those of skill in the art and appropriate variations are contemplated depending on the type of device, such as whether the device 100 is a small, handheld computing device, a desktop computer, or a computer server.

Although the exemplary embodiment described herein employs the hard disk 160, it should be appreciated by those skilled in the art that other types of computer readable media which can store data that are accessible by a computer, such as magnetic cassettes, flash memory cards, digital versatile disks, cartridges, random access memories (RAMs) 150, read only memory (ROM) 140, a cable or wireless signal containing a bit stream and the like, may also be used in the exemplary operating environment. Non-transitory computer-readable storage media expressly exclude media such as energy, carrier signals, electromagnetic waves, and signals per se.

To enable user interaction with the computing device 100, an input device 190 represents any number of input mechanisms, such as a microphone for speech, a touch-sensitive screen for gesture or graphical input, keyboard, mouse, motion input, speech and so forth. An output device 170 can also be one or more of a number of output mechanisms known to those of skill in the art. In some instances, multimodal systems enable a user to provide multiple types of input to communicate with the computing device 100. The communications interface 180 generally governs and manages the user input and system output. There is no restriction on operating on any particular hardware arrangement and therefore the basic features here may easily be substituted for improved hardware or firmware arrangements as they are developed.

For clarity of explanation, the illustrative system embodiment is presented as including individual functional blocks including functional blocks labeled as a "processor" or processor 120. The functions these blocks represent may be provided through the use of either shared or dedicated hardware, including, but not limited to, hardware capable of executing software and hardware, such as a processor 120, that is purpose-built to operate as an equivalent to software executing on a general purpose processor. For example the functions of one or more processors presented in FIG. 1 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 140 for storing software performing the operations discussed below, and random access memory (RAM) 150 for storing results. Very large scale integration (VLSI) hardware embodiments, as well as custom VLSI circuitry in combination with a general purpose DSP circuit, may also be provided.

The logical operations of the various embodiments are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. The system 100 shown in FIG. 1 can practice all or part of the recited methods, can be a part of the recited systems, and/or can operate according to instructions in the recited non-transitory computer-readable storage media. Such logical operations can be implemented as modules configured to control the processor 120 to perform particular functions according to the programming of the module. For example, FIG. 1 illustrates three modules Mod1 162, Mod2 164 and Mod3 166 which are modules configured to control the processor 120. These modules may be stored on the storage device 160 and loaded into RAM 150 or memory 130 at runtime or may be stored as would be known in the art in other computer-readable memory locations.

Having disclosed some components of a computing system, the disclosure now returns to a discussion of self-service TTS web services through an API. This approach can replace a monolithic TTS synthesizer by effectively splitting a TTS synthesizer into discrete parts. For example, the TTS synthesizer can include parts for language analysis, database search for appropriate units, acoustic synthesis, and so forth. The system can include all or part of these components as well as other components. In this environment, a user uploads voice data on a client device that accesses the server over the Internet via an API and the server provides voice. This configuration can also provide the ability for a client who has a module in a language unsupported by the server to use the rest of the server's TTS mechanisms to create a voice in that unsupported language. This approach can be used to cobble together a voice for testing, prototyping, or live services to see how the client's front-end fits together with the server back end before the client and server organizations make a contract to share the components.

Figure 2:
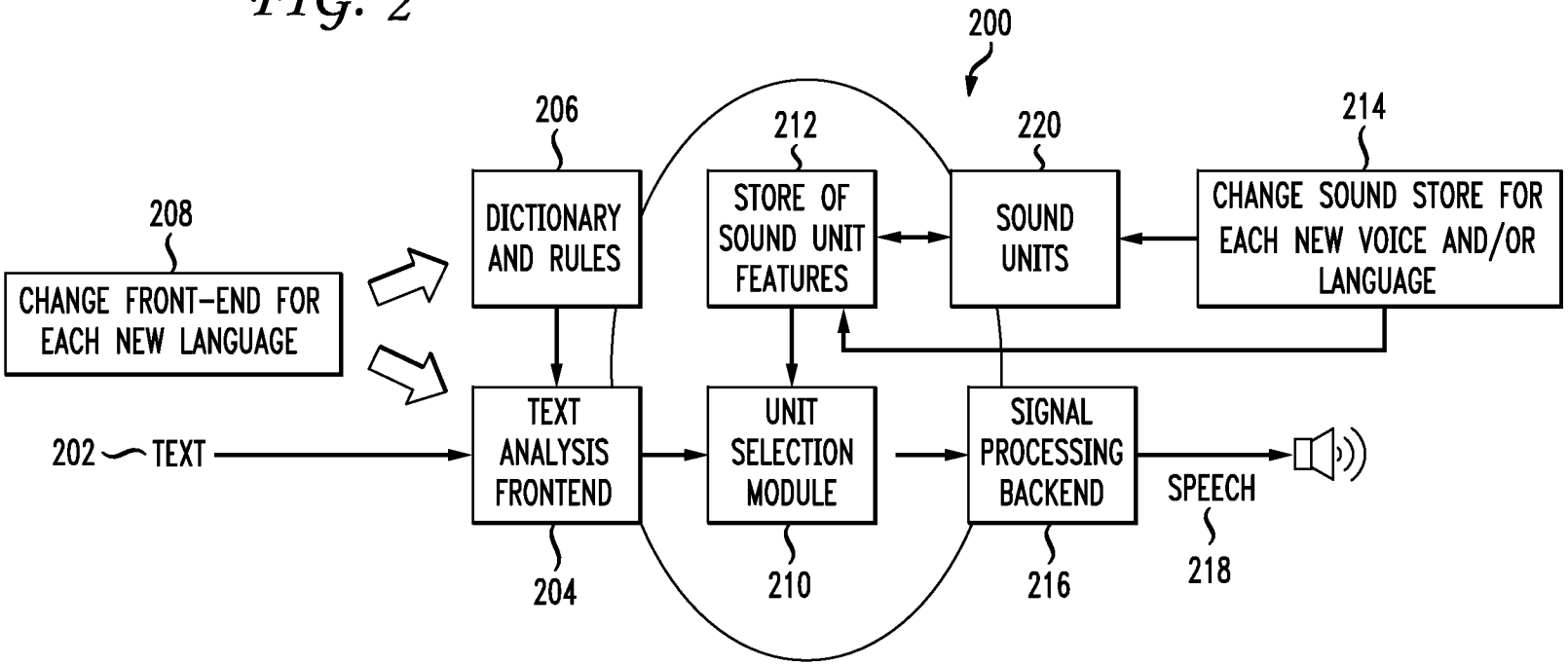
FIG. 2 illustrates an exemplary block diagram of a unit-selection text-to-speech system.

Each discrete part of the TTS synthesizer approach 200 shown in FIG. 2 produces valuable output. One main input to a text-analysis front end 204 is text 202 such as transcriptions of speech. The input text 202 can be written in a single language or in multiple languages. The text analysis front end 204 processes the text 202 based on a dictionary and rules 206 that can change for different languages 208. Then a unit selection module 210 processes the text analysis in conjunction with a store of sound unit features 212 and sound units 220. This portion illustrates that the acoustic or sound units 220 are independent of the sound unit features 212 or other feature data required for unit selection. The sound unit features 212 may be of only limited value without the actual associated audio.

The text analysis front end 204 can model sentence and word melody, as well as stress assignment (all part of prosody) to create symbolic meta-tags that form part of the input to the unit selection module 210. The unit selection module 210 uses the text front end's output stream as a "fuzzy" search query to select the single sequence of speech units from the database that optimally synthesizes the input text. The system can change the sound unit features 212 and store of sound units 220 for each new voice and/or language 214. Then, a signal processing backend 216 concatenates snippets of audio to form the output audio stream that one can listen to, using signal processing to smooth over the concatenation boundaries between snippets, modifying pitch and/or durations in the process, etc. The signal processing backend 216 produces synthesized speech 218 as the "final product" of the left-to-right value chain. Even the identities of the speech units selected by the unit selection module 210 have value, for example, as part of an information stream that can be used as a very low bit-rate representation of speech. Such a low bit-rate representation can be suitable, for example, to communicate by voice with submarines. Another benefit is that the "fuzzy" database search query produced by the text-analysis front end 204 is a compact, but necessarily rich, symbolic representation for how a TTS system developer wants the output to sound.

This approach also makes use of the fact that this front-end 204 and the unit-selection 210 and backend 216 can reside elsewhere and can be produced, operated, and/or owned by separate parties. Accordingly, the boundary between unit selection 210 and signal-processing backend 216 can also be used to choose one or more from a variety of different owners/creators of modules. This approach allows a user to combine proprietary modules that are owned by separate parties for the purpose of forming a complete TTS system over the web, without disclosing one party's intellectual property to the other, as would be necessary to integrate each party's components into a standalone complete TTS system.

In one typical scenario, the linguistic and phonetic expertise for a specific language resides within the country where the specific language is spoken natively such as Azerbaijan, while the expertise for the unit-selection algorithms and signal-processing backend and their implementations might reside in a different country such as the United States. A server can operate the signal processing backend 216 and make the back end available via a comprehensive set of web APIs that allow "merging" different parts of a complete system. This arrangement allows collaboration of different teams across the globe towards a common goal of creating a complete system and allows for optimal use of each team's expertise while keeping each side's intellectual property separate during development.

Figure 3:
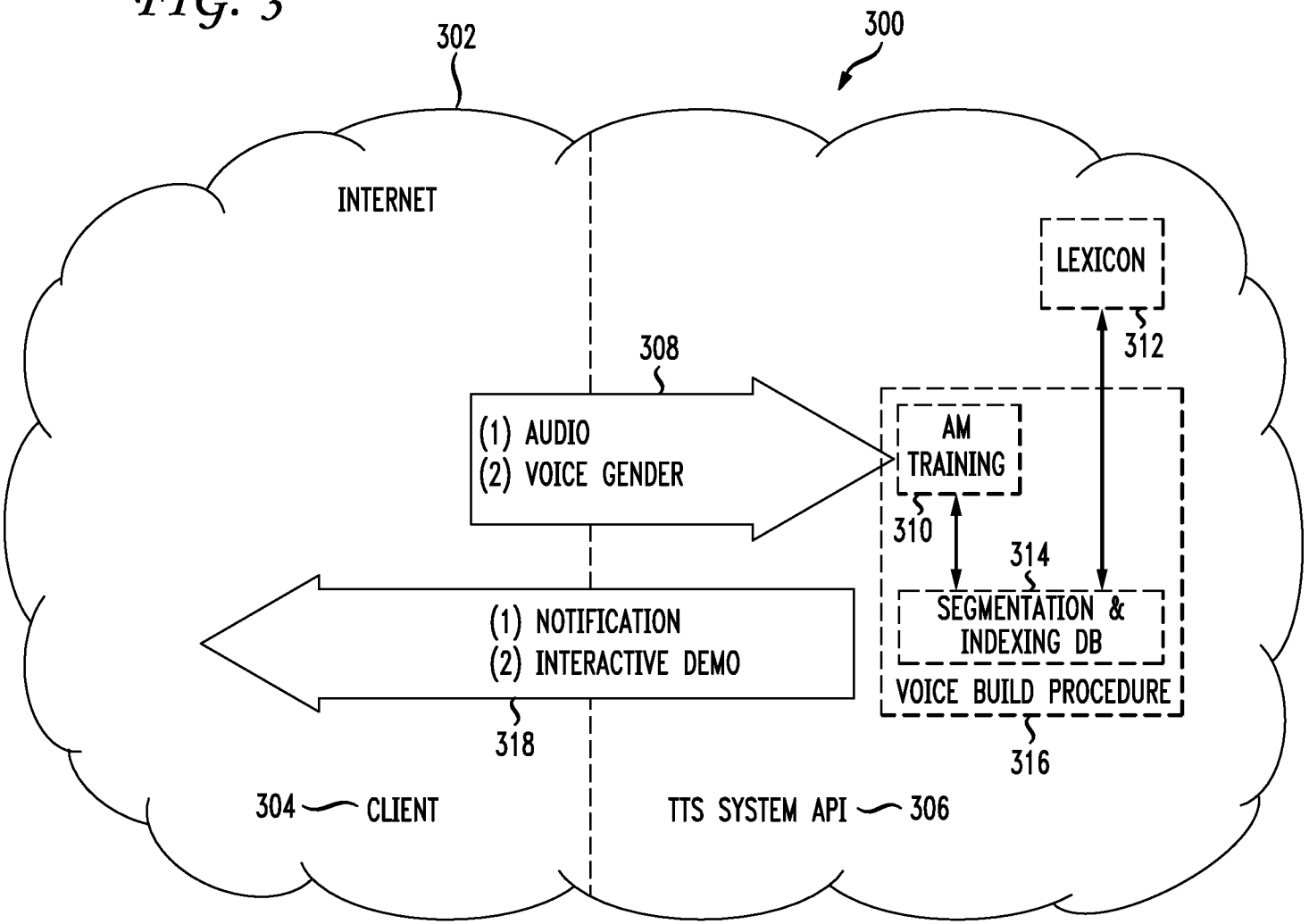
FIG. 3 illustrates an exemplary web-based service for building a text-to-speech voice.

In another aspect, illustrated in FIG. 3, the system 300 facilitates TTS voice building over the Internet 302. TTS vendors often get requests from highly motivated customers for special voices, such as a specific person who will lose his/her voice due to illness, or a customer request for a special "robot" voice for a specific application. The cost, labor, and computations required for building such a custom TTS voice can be prohibitive using more traditional approaches. This web-hosted approach for "self-service" voice building shifts the labor intensive parts to the customer while retaining the option of expert intervention on the side of the TTS system vendor.

In such a scenario, the "client" 304 side provides the audio and some meta information 308, for example, about the gender, age, ethnicity, etc. of the speaker to set the proper pitch range. The client 304 can also provide the voice-talent recordings and textual transcriptions that correspond accurately to the audio recordings. The client 304 provides this information to the voice-building procedure 316 of the TTS system 306 exposed to the client by a comprehensive set of APIs. When the voice build procedure completes, the TTS system 306 notifies the client 304 that the TTS voice was successfully built and invites the client 304 to an interactive demo of this voice. The interactive demo can provide, for example, a way for the client to enter arbitrary input text and receive corresponding audio for evaluation purposes, such as before integrating the voice database fully with the production TTS system.

The voice-build procedure 316 of the TTS system 306 includes an acoustic (or other) model training module 310, a segmentation and indexing database 314, and a lexicon 312. The voice-build procedure 316 of the TTS system 306 creates a large index of all speech units in the input set of audio recordings 308. For this, the TTS system 306 first trains a speaker or voice dependent Acoustic Model (AM) for segmenting the audio phonetically via an automatic speech recognizer. In one variation, segmenting includes marking the beginning and end of each phoneme. The speech recognizer can segment each recording in a forced alignment mode where the phoneme sequence to be aligned is derived from the also supplied text that corresponds accurately to what is being said. After creating the index 314, the voice build procedure 316 of the TTS system 306 can also compute other information, such as unit-selection caches to rapidly choose candidate acoustic units or compute unit compatibility or "join" costs, and store the other information in the TTS voice database 314.

The TTS system 306 can communicate data between modules as simple tables, as phonemes plus features, unit numbers plus features, and/or any other suitable data format. These exemplary information formats are compact and easily transferred, enabling practical communication between TTS modules or via a web API. Even if a TTS system 306 modules do not use such a data format naturally, the output they do produce can be rewritten, transcoded, converted, and/or compressed into such a format by interface handler routines, thus making disparate systems interoperable.

The process of creating TTS modules and creating high quality voices is difficult. Writing programs to implement text-analysis frontends can require extensive manual effort, including creating pronunciation dictionaries and/or Letter-to-Sound (LTS) rules, text normalization, and so forth. Voice recordings require high-quality microphone and recording equipment such as those found in recording studios. Segmentation and labeling requires good speech recognition and other software tools.

The principles disclosed herein are applicable to a variety of usage scenarios. One common element in these example scenarios is that two parties team up to overcome the generally high barriers to begin creating a new TTS system for a given language. One barrier in particular is the need for an instantiation of all modules to create audible synthetic speech. Each party uses their different skills to create language modules and voices more efficiently and at a higher quality together than doing it alone. For example, one party may have a legacy language module but no voices. Another party may have voices or recordings but no ability to perform text analysis.

The approaches disclosed herein provide the ability for a client to submit detailed phonetic information to a TTS system instead of pure text, and receive the resulting audio. This approach can be used to perform synthesis based on proprietary language modules, for example, if a client has a legacy (pre-existing) language module.

In another variation, the system introduces additional modules into the original data flow, possibly involving human intervention. For research or commercial purposes, the system can detect and/or correct defects output by one module before passing the data on to the next module. Some examples of programmatic correction include modifying incoming text, performing expansions that the frontend does not handle by default, modifying phonetic input to accommodate varying usage between systems (such as /f ao r/ or /f ow r/ for the word "four"), and injecting pre-tested units to represent specific words or phrases.

For audio that is created once and stored for later playback, a human listener can also judge the resulting audio, modifying data at one or more stages to improve the output. Such tools, often called "prompt sculptors", can be tightly integrated into the core of a TTS system, but can also be applied to a distributed collection of proprietary modules. Prompt sculptors can, for example, change the prescribed prosody of specific words or phrases before unit selection to increase emphasis, and remember the unit sequences corresponding to good renderings of frequent words and phrases for re-use when that text reappears.

Figure 4:
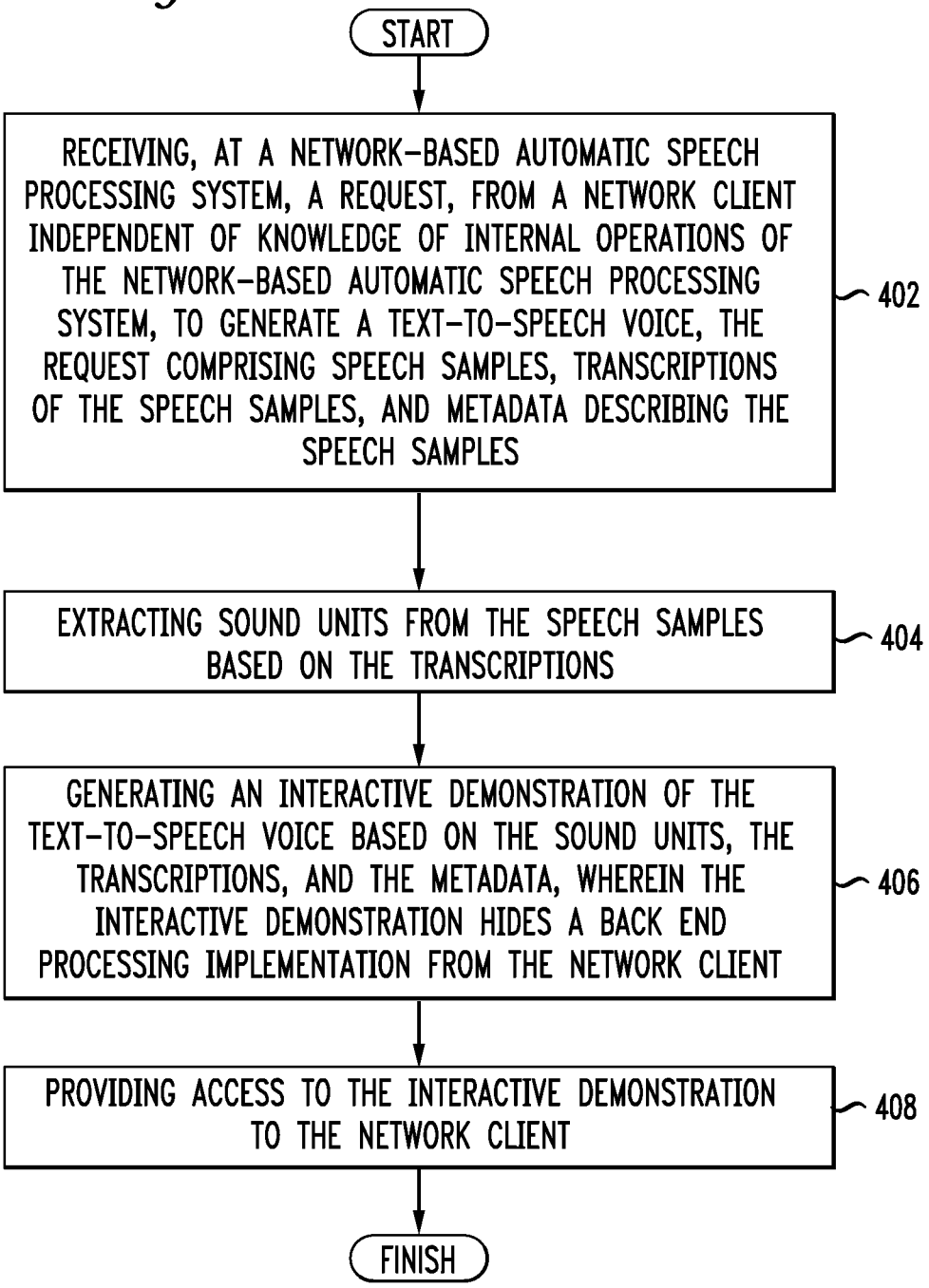
FIG. 4 illustrates an example method embodiment for a server.
Figure 5:
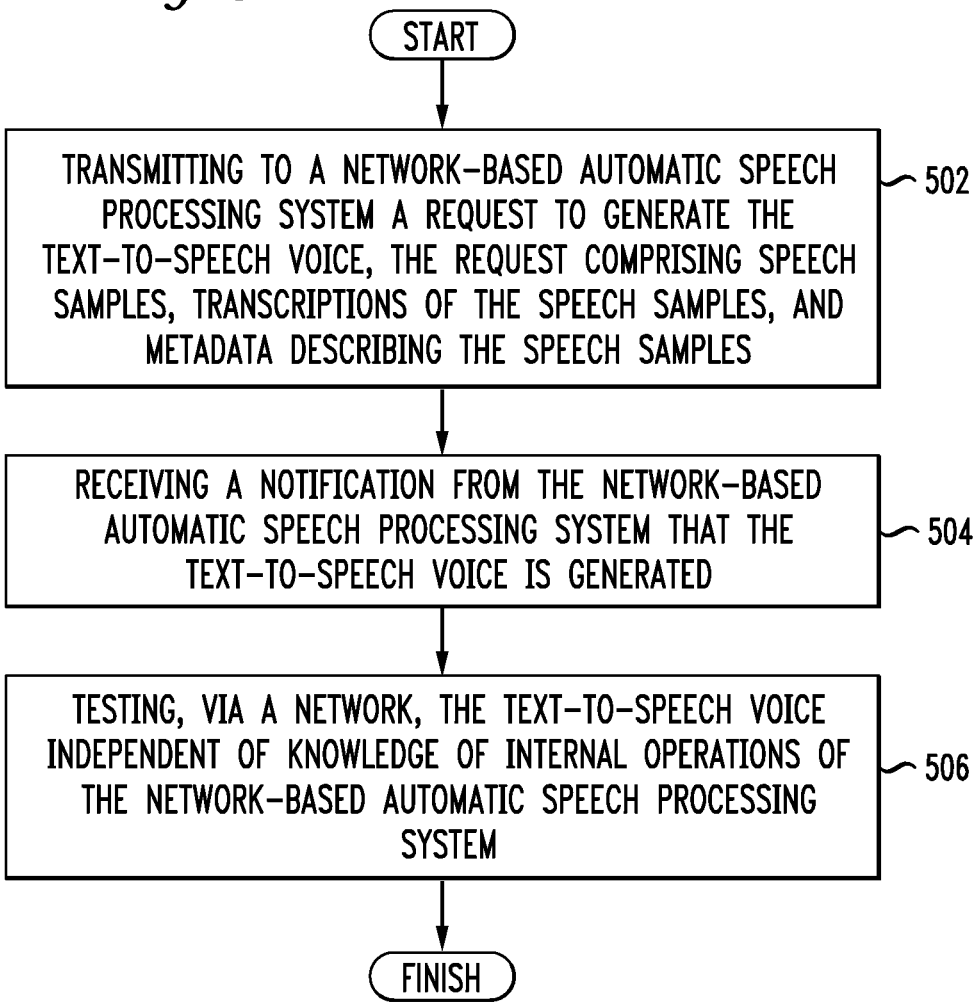
FIG. 5 illustrates an example method embodiment for a client.

Having disclosed some basic system components and concepts, the disclosure now turns to the exemplary method embodiments shown in FIGS. 4 and 5. For the sake of clarity, the methods are discussed in terms of an exemplary system 100 as shown in FIG. 1 configured to practice the methods. The steps outlined herein are exemplary and can be implemented in any combination thereof, including combinations that exclude, add, or modify certain steps.

FIG. 4 illustrates an example method embodiment for a server. The server, such as a network-based automatic speech processing system, receives a request to generate a text-to-speech voice from a network client that has no access to and knowledge of internal operations of the network-based automatic speech processing system (402). The request can include speech samples, transcriptions of the speech samples, and metadata describing the speech samples. The server can receive the request via a web interface based on an API. In one aspect, the server and/or the client requires that the speech samples meet a minimum quality threshold. The server can include components such as a language analysis module, a database, and an acoustic synthesis module.

The server extracts sound units from the speech samples based on the transcriptions (404) and generates a web interface, interactive or non-interactive demonstration, standalone file, or other output of the text-to-speech voice based on the sound units, the transcriptions, and the metadata, wherein the interactive demonstration hides a back end processing implementation from the network client (406). The server can also modify one or more of the sound units and the interactive demonstration based on an intervention from a human expert. The text-to-speech voice can be tailored for a specific language or language agnostic.

The server provides access to the interactive demonstration to the network client (408). The server can provide access via a downloadable application, a web-based speech synthesis program, a set of phones, a TTS voice, etc. In one example, the server provides a non-interactive or limited-interaction demonstration in the form of sample synthesized speech. In conjunction with the demonstration, the system can generate a log associated with how at least part of the interactive demonstration was generated and share all or part of the log with the client. The log can provide feedback to the client and guide efforts to tune or otherwise refine the parameters and data input to the server for another iteration. The server can optionally receive an additional request from the network client for the text-to-speech voice and provide the text-to-speech voice to the network client.

In one variation, the system helps the client focus the speech samples to avoid wasted time and effort. For example, the system can analyze the speech samples, determine a coverage hole in the speech samples for a particular purpose, and suggest to the network client a type, category, or particular content of additional speech sample intended to address the coverage hole. Then the client can prepare and submit additional speech samples based on the suggestion. The server and client can iteratively perform these steps until a threshold coverage for the particular purpose is reached. The system can use an iterative algorithm to compare additional audio files and suggest what to cover next, such as a specific vocabulary for a particular domain, for higher efficiency and to avoid repeating things that are not needed or are already done.

FIG. 5 illustrates an example method embodiment for a client. In this example, the client transmits to a network-based automatic speech processing server a request to generate the text-to-speech voice, the request comprising speech samples, transcriptions of the speech samples, and metadata describing the speech samples (502). Due to the usually lengthy process of generating a text-to-speech voice, the server may provide the response to the client minutes, hours, days, weeks, or longer after the initial request. Due to this delay, the request can include some designation of an address, delivery mode, status update frequency, etc. for delivering the response to the request. For example, the delivery mode can be email.

The client then receives a notification from the server that the text-to-speech voice is generated (504) and can test or assist a user in testing, via a network, the text-to-speech voice independent of access to and knowledge of internal operations of the server (506). The separation of data and algorithms between a client and a server provides a way for each to evaluate the likelihood of success for a more close collaboration on speech generation without compromising sensitive intellectual property of either party.

Embodiments within the scope of the present disclosure may also include tangible and/or non-transitory computer-readable storage media for carrying or having computer-executable instructions or data structures stored thereon. Such non-transitory computer-readable storage media can be any available media that can be accessed by a general purpose or special purpose computer, including the functional design of any special purpose processor as discussed above. By way of example, and not limitation, such non-transitory computer-readable media can include RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Those of skill in the art will appreciate that other embodiments of the disclosure may be practiced in network computing environments with many types of computer system configurations, including personal computers, hand-held devices, multi-processor systems, microprocessor-based or programmable consumer electronics, network PCs, mini-computers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

The various embodiments described above are provided by way of illustration only and should not be construed to limit the scope of the disclosure. For example, the principles herein can be adapted for use via a web interface, a mobile phone application, or any other network-based embodiment. Those skilled in the art will readily recognize various modifications and changes that may be made to the principles described herein without following the example embodiments and applications illustrated and described herein, and without departing from the spirit and scope of the disclosure.

We claim:

1. A method comprising:

receiving, at a network-based automatic speech processing system and from a network client not having access to information of internal operations of the network-based automatic speech processing system, a request to generate a text-to-speech voice, the request comprising a transcription;

extracting sound units from speech samples based on the transcription;

generating a demonstration of the text-to-speech voice based only on the sound units and the transcriptions, wherein the text-to-speech voice is language agnostic; and providing access to the demonstration to the network client.

2. The method of claim 1, the request further comprising the speech samples and metadata describing the speech samples.

3. The method of claim 2, wherein the transcription is of the speech samples.

4. The method of claim 1, further comprising:

receiving an additional request from the network client for the text-to-speech voice; and providing the text-to-speech voice to the network client.

5. The method of claim 1, wherein the request is received via a web interface.

6. The method of claim 1, wherein the speech samples are required to meet a minimum quality threshold.

7. The method of claim 1, wherein the network-based speech processing system comprises a language analysis module, a database, and an acoustic synthesis module.

8. The method of claim 1, wherein the text-to-speech voice is language agnostic.

9. The method of claim 1, further comprising:

analyzing the speech samples;

determining a coverage hole in the speech samples for a particular purpose; and suggesting, to the network client, a type of additional speech sample intended to address the coverage hole.

10. The method of claim 9, wherein the analyzing, the determining, and the suggesting is done iteratively until a threshold coverage for the particular purpose is reached.

11. The method of claim 1, further comprising generating a log associated with the demonstration.

12. The method of claim 11, further comprising transmitting the log to the network client.

13. The method of claim 1, further comprising modifying one of the sound units and the demonstration based on an intervention from a human expert.

14. A system comprising:

a processor; and a computer-readable storage medium having instructions stored which, when executed by the processor, cause the processor to perform operations comprising:

receiving, at a network-based automatic speech processing system and from a network client not having access to information of internal operations of the network-based automatic speech processing system, a request to generate a text-to-speech voice, the request comprising a transcription;

extracting sound units from speech samples based on the transcription;

generating a demonstration of the text-to-speech voice based only on the sound units and the transcriptions, wherein the text-to-speech voice is language agnostic; and providing access to the demonstration to the network client.

15. The system of claim 14, the request further comprising the speech samples and metadata describing the speech samples.

16. The system of claim 15, wherein the transcription is of the speech samples.

17. The system of claim 14, the computer-readable storage medium having additional instructions stored which, when executed by the processor, cause the processor to perform operations comprising:

receiving an additional request from the network client for the text-to-speech voice; and providing the text-to-speech voice to the network client.

18. The system of claim 14, wherein the request is received via a web interface.

19. The system of claim 14, wherein the speech samples are required to meet a minimum quality threshold.

20. A computer-readable storage device having instructions stored which, when executed by a computing device, cause the computing device to perform operations comprising:

receiving, at a network-based automatic speech processing system and from a network client not having access to information of internal operations of the network-based automatic speech processing system, a request to generate a text-to-speech voice, the request comprising a transcription;

extracting sound units from speech samples based on the transcription;

generating a demonstration of the text-to-speech voice based only on the sound units and the transcriptions, wherein the text-to-speech voice is language agnostic; and providing access to the demonstration to the network client.

* * * * *